US006998584B1

(12) United States Patent
Luo

(10) Patent No.: US 6,998,584 B1
(45) Date of Patent: Feb. 14, 2006

(54) SYSTEM FOR OUTPUT POWER CONTROL ON ELECTRIC HEATER DRIVE

(75) Inventor: Yuwei Luo, Lisle, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/933,262

(22) Filed: Sep. 3, 2004

(51) Int. Cl.
*H05B 1/02* (2006.01)

(52) U.S. Cl. ..... 219/486; 219/483; 307/38; 307/41

(58) Field of Classification Search ..... 219/483, 219/486, 485, 492, 497, 202, 506, 205; 37/38–41
See application file for complete search history.

(56) References Cited

U.S. PATENT DOCUMENTS 4,333,002 A * 6/1982 Kozak ..... 392/451
4,588,875 A * 5/1986 Kozak et al. ..... 219/485
4,638,147 A * 1/1987 Dytch et al. ..... 392/485
5,582,756 A 12/1996 Koyama
6,080,971 A * 6/2000 Seitz et al. ..... 219/483
6,139,627 A * 10/2000 Duval et al. ..... 117/81
6,389,226 B1 * 5/2002 Neale et al. ..... 392/485
2002/0030048 A1 * 3/2002 Ziaimehr et al. ..... 219/486

* cited by examiner

*Primary Examiner*—Mark Paschall
(74) *Attorney, Agent, or Firm*—Finnegan, Henderson, Farabow, Garrett & Dunner

(57) ABSTRACT

Methods and systems are provided for controlling the output power to DC electric heater elements to reduce the input current ripple and to fine-tune the output power to meet the fine-tuning percentage requirement. In one embodiment, a method is performed for controlling output power to heater elements in an electric heater system. The process includes receiving a power request by the heater system, providing output power controls for each heater element, and determining a particular output power control based on output power controls provided for each heater element and the power requested. Further, the heater system selectively controls the output power to one or more of the heater elements to meet the power request.

15 Claims, 4 Drawing Sheets

SYSTEM FOR OUTPUT POWER CONTROL ON ELECTRIC HEATER DRIVE

TECHNICAL FIELD

This disclosure relates generally to electric heater control systems, and more particularly to systems and methods for providing improved output power controls to electric heater elements.

BACKGROUND

DC electric heaters usually consist of a plurality of heater elements connected in parallel, series, or both. When a desirable temperature range is specified, a control system of the electric heater system controls the output power to the heater elements by turning on a determined number of heater elements while turning off the remaining heater elements to approximately meet the desired temperature. The resolution of this type of control system, however, is limited by the number of heater elements. This limitation restricts the DC electric heaters from meeting certain fine-tuned percentage output power requirements.

In order to fine-tune the output power to the heater elements, some conventional systems use Pulse Width Modulation (PWM) to control the output power to all the heater elements. One such system is described in U.S. Pat. No. 5,582,756 to Hideki Koyama. The '756 system includes a heater control device that uses a PWM signal for controlling a switch that turns on and off the entire electric heater. A PWM circuit works by making a square wave with a variable on-to-off ratio, also called a duty cycle, such that a variable amount of power is applied to the load. The duty cycle is a percentage number calculated by $T_{on}/(T_{on}+T_{off})$, where $T_{on}$ is the time period when power is applied to the load, $T_{off}$ is the time period when power is not applied to the load, and the duty cycle T is the total of $T_{on}$ and $T_{off}$. If $T_{on}=T_{off}$, then the duty cycle is 50%, which means 50% of power is applied to the load. However, to achieve the desirable result, the cycle period T must be short relative to the load's response time to the change in ON/OFF state. Therefore, the PWM frequency has to be kept at a high rate. In such instances, it is not uncommon that the PWM frequency reaches tens of KHz, sometimes up to one hundred KHz or even more. As the frequency increases, the fast switching between ON and OFF states in the load circuitry will generate high input current ripple. This can affect the lifetime of certain circuitry, such as a bus capacitor, and may also cause radio frequency interference (RFI) that affects other electronic components in the DC electric heater or other nearby electronic equipment.

To address the high input current ripple problem, conventional DC electric heater systems may use additional input filters. This solution, however, will inevitably add more complexities to the circuitry and extra cost to the overall system.

Methods and systems consistent with certain features of the disclosed specification are directed to solving one or more of the problems set forth above.

SUMMARY OF THE INVENTION

In one embodiment, a method is performed for controlling output power to heater elements in an electric heater system. The process includes receiving a power request by the heater system, providing output power controls for each heater element, and determining a particular output power control based on output power controls provided for each heater element and the power requested. Further, the heater system selectively controls the output power to one or more of the heater elements to meet the power request.

In another embodiment, a system is provided for controlling output power to heater elements in an electric heater system. The system includes a memory including program code that performs an operation process including receiving a power request including a requested power value and, based on the power value, determining a first set of the heater elements to operate in a constant ON/OFF mode. The operation process may also include determining a second set of the heater elements to operate in a PWM controlled mode and providing power to the first and second sets of heater elements based on the power value and a predetermined algorithm. Further, the system includes a microcontroller executing the program code to control power to the heater elements.

BRIEF DESCRIPTION OF THE DRAWINGS

The accompanying drawings, which are incorporated in and constitute a part of this specification, illustrate several aspects of disclosed embodiments and together with the description, serve to explain the principle of the invention. In the drawings.

DETAILED DESCRIPTION

Reference will now be made in detail to exemplary embodiments that are illustrated in the accompanying drawings. Wherever possible, the same reference numbers will be used throughout the drawings to refer to the same or like parts.

Figure 1:
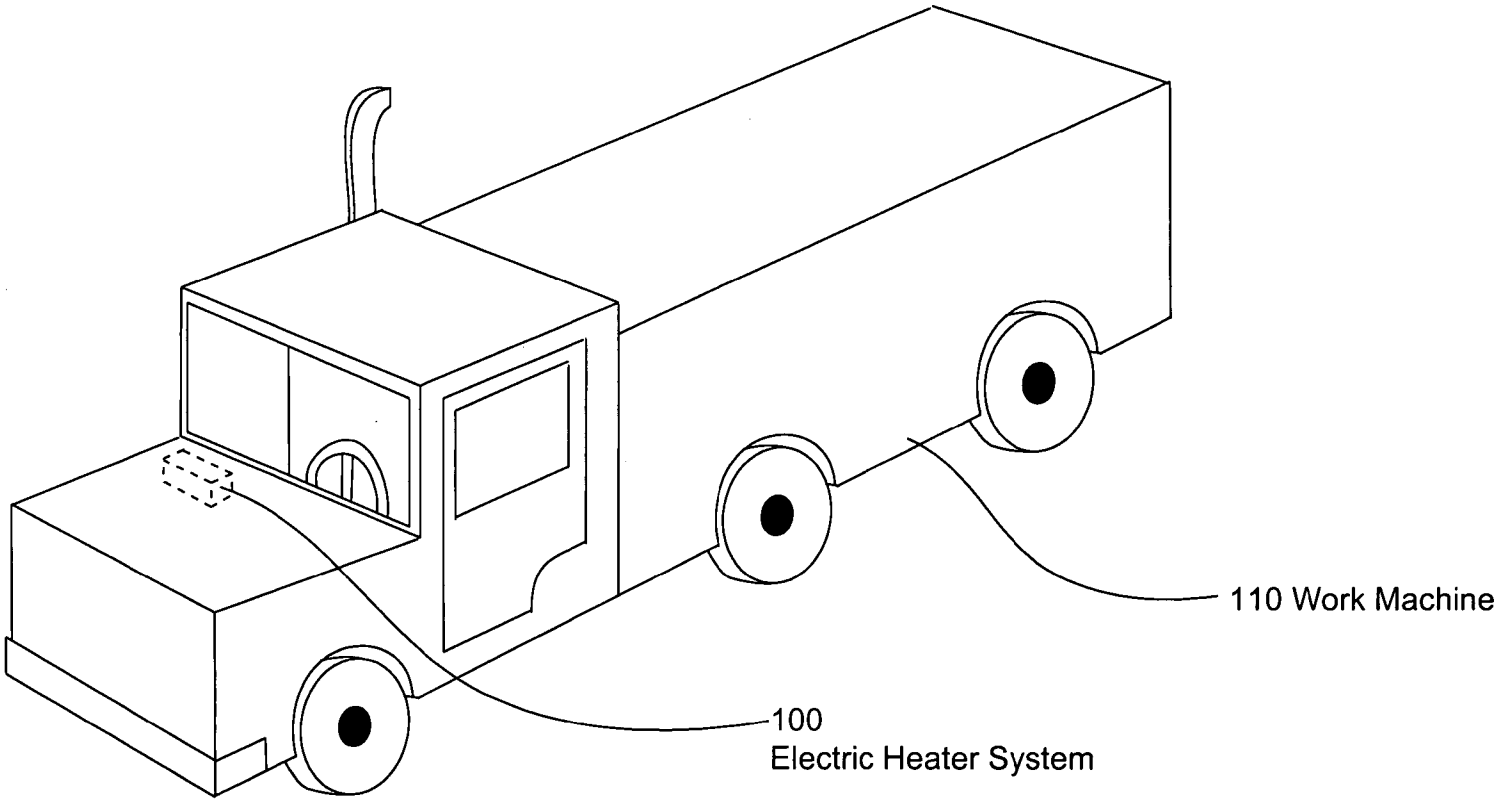
FIG. 1 is a pictorial illustration of a vehicle incorporating an exemplary DC electric heater system.

FIG. 1 illustrates an exemplary electric heater system 100 incorporated into a cabin of a work machine 110. The electric heater system 100 is used to provide variable temperature ranges within the cabin of work machine 110.

Work machine, as the term is used herein, refers to a fixed or mobile machine that performs some type of operation associated with a particular industry, such as mining, construction, farming, etc., and operates between or within work environments (e.g., construction site, mine site, power plants, etc.). Non-limiting examples of mobile machines include commercial machines, such as trucks, cranes, earth moving vehicles, mining vehicles, backhoes, material handling equipment, farming equipment, marine vessels, aircraft, and any type of movable machine that operates in a work environment. Although FIG. 1 shows heater system 100 incorporated in a truck type work machine, system 100 may be implemented in any type of work machine, such as those described above. Further, heater system 100 may also be used in other environments, such as rooms, booths, or any environment where a temperature range may be fine-tuned.

Figure 2:
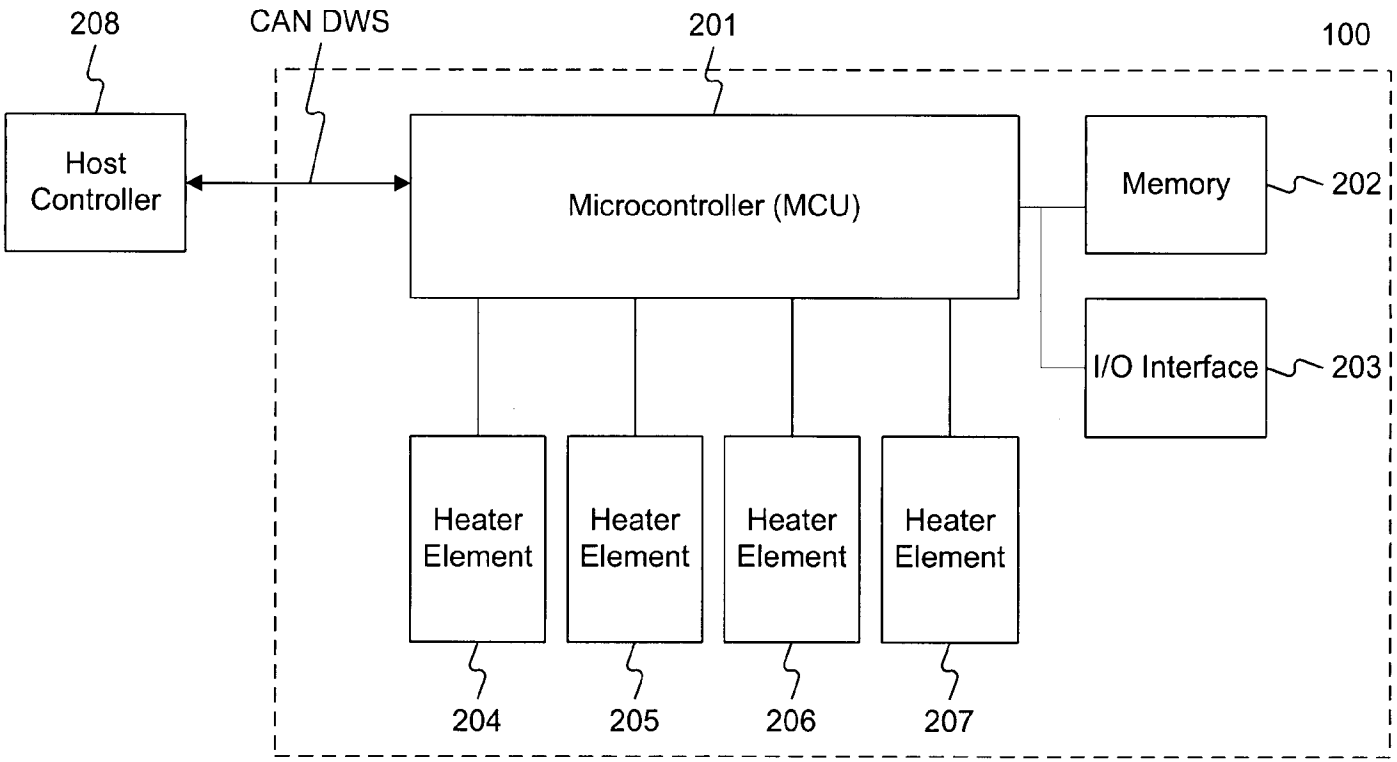
FIG. 2 illustrates a block diagram of an exemplary control system consistent with certain disclosed embodiments.

FIG. 2 illustrates a block diagram of heater system 100 consistent with certain disclosed embodiments. As shown in FIG. 2, heater system 100 may include microcontroller unit (MCU) 201, memory module 202, I/O interface 203, and heater elements 204, 205, 206, and 207. A host controller 208 communicates with MCU 201 to facilitate the implementation of control functions for heater system 100.

MCU 201 may be configured as a separate processor module dedicated to provide output power control functions. Additionally or alternatively, MCU 201 may be configured as a shared processor module performing other functions unrelated to output power control functions. MCU 201 may be one or more microcontrollers with on-board memory, dedicated PWM ports, and I/O ports. Further, MCU 201 may include a microprocessor supported by various memory modules and peripheral devices. In one embodiment, MCU 201 communicates with host controller 208 by exchanging J1939 messages over a CAN bus. Other communication protocols and bus types, however, may be used.

Memory 202 may be one or more memory devices including, but not limited to, a ROM, a flash memory, a dynamic RAM, and a static RAM. Memory 202 may be configured to store information used by MCU 201. Further, memory 202 may be external or internal to MCU 201. I/O interface 203 may be one or more input/output interface devices receiving data from MCU 201 and sending data to MCU 201, such as interrupt signals. Heater elements 204, 205, 206, and 207 are coupled in parallel to MCU 201. Each heater element may be coupled in a way such that it can be either PWM controlled or constant ON/OFF controlled. Although four heater elements in a parallel configuration are shown in FIG. 2, any number of the heater elements and configurations may be implemented.

During operations of heater system 100, MCU 201 may perform status computation and mode management processes. In one embodiment, such processes enable MCU 201 to PWM control one or more selected heater elements 204–207, while controlling any remaining heater elements through constant ON/OFF control processes (i.e., non-PWM control). Further, MCU 201 may rotate the duty (i.e., providing heat when applied power) of heater elements 204–207 to minimize the stress on the heater elements. Because those heater elements that are constant ON/OFF controlled do not introduce input current ripples, the amount of the input current ripple may be reduced to only that introduced by the selected PWM controlled heater element. This configuration reduces the input current ripple by a factor equal to the number of parallel elements, while still allowing heater system 100 to maintain fine-tuning capabilities. Further, as a part of the status computation process, MCU 201 monitors and calculates the average power, the instant value and average value of total current, temperature readings, average input voltage, and average output voltage on each heater element. MCU 201 may be configured to provide status information associated with this determined data (e.g., average power) to host controller 208.

MCU 201 may also monitor the communication channel between MCU 201 and host controller 208, which is used for receiving commands from host controller 208 and sending status information back to host controller 208. MCU 201 may also receive interrupts from I/O interface 203 based on fault or non-fault conditions detected within heater systems 100. Such conditions may include over-current conditions, de-saturation conditions, and/or timeout conditions. After MCU 201 receives communication from host controller 208 or is interrupted by I/O interface 203, MCU 201 performs some initial processing, then returns to perform the status computation and mode management processes based on commands received from host controller 208 or interrupts received from I/O interface 203 or any other component of heater system 100.

Figure 3:
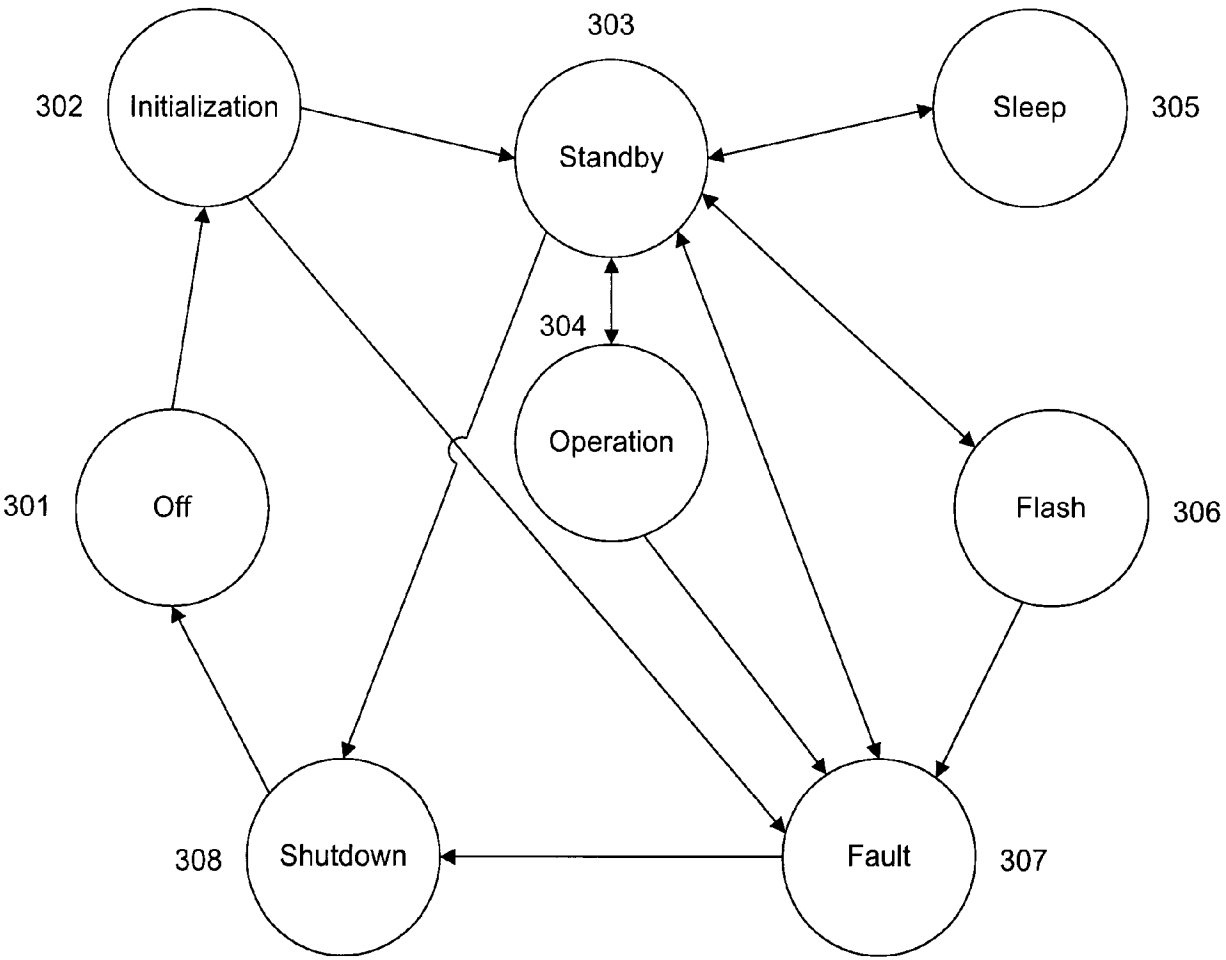
FIG. 3 illustrates a state machine diagram of an exemplary microcontroller to perform control functions consistent with certain disclosed embodiments.

FIG. 3 shows a state machine diagram of various states implemented by one or more software programs stored in memory 202 and executed by MCU 201 while performing the status computation and mode management processes. The state machine diagram reflects various operational states of the software programs and the reactions to a particular event during a particular state. In one embodiment, the state machine diagram includes eight states: "OFF" state 301, "INITIALIZATION" state 302, "STANDBY" state 303, "OPERATION" state 304, "SLEEP" state 305, "FLASH" state 306, "FAULT" state 307, and "SHUTDOWN" state 308. Although FIG. 3 shows eight states, any number of states may be implemented by the software programs executed by MCU 201.

"OFF" state 301 may be a starting state in which MCU 201 is not initialized, such as when MCU 201 is not operating or performing any functions. Subsequently, MCU 201 may be turned on or reset, thus causing the state to transition to "INITIALIZATION" state 302. On entering "INITIALIZATION" state 302, the software programs perform various initialization processes and diagnostics tests, such as register configuration and memory allocation, configuring system clock oscillator (OSC), initialization of a reset register, memory management, initialization and test on watchdog circuitry, CAN, comparators, comparator voltage references, D/A converters, and PWM capture, etc. If there is any fault detected during the initialization and diagnostic processes, the state transitions to "FAULT" state 307. Otherwise, if all the initialization processes are successful and all the diagnostics tests have passed without detecting a fault event, the state transitions to "STANDBY" state 303. In "STANDBY" state 303, the power stage operation is stopped, thus no output power is applied to the load. Heater system 100, however, is ready for power stage operations.

Figure 4:
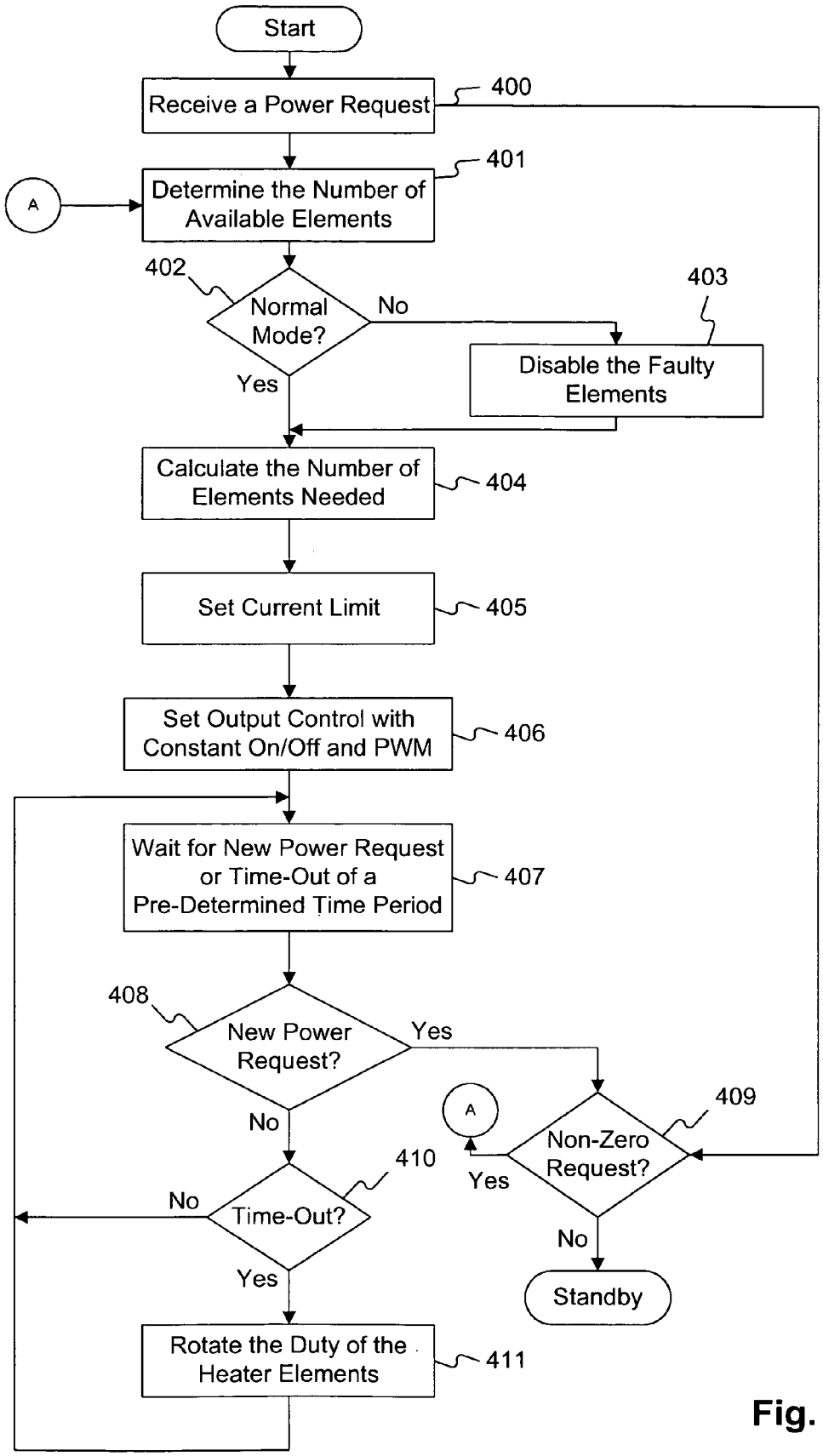
FIG. 4 illustrates a flowchart of an exemplary operation state of the microcontroller consistent with certain disclosed embodiments.

While in "STANDBY" state 303, MCU 201 may receive a power request that may or may not be a request for some amount of power to be applied to a load. If this occurs, the state transitions to "OPERATION" state 304. FIG. 4 shows a flow chart of an operation process performed by MCU 201 while in "OPERATION" state 304. Initially, MCU 201 may receive a power request from host controller 208 reflecting an amount of power required for providing a desired temperature range from heater elements 204, 205, 206, and 207 (Step 400). MCU 201 may then determine whether the power request is a non-zero power request (i.e., a request for some power), as opposed to a zero power request (i.e., a request for no power reflecting non-use of heater system 100) (Step 409). If the power request is a non-zero power request (Step 409; Yes), the operation process continues to Step 401. On the other hand, if the power request is a zero power request (Step 409; No), MCU 201 transitions from "OPERATION" state 304 to "STANDBY" state 303.

In Step 401, MCU 201 may determine the total number of available heater elements 204, 205, 206, and 207 in heater system 100. For example, if during a diagnostic process, MCU 201 detects a faulty heater element (e.g., element 204), MCU 201 may determine that the total number of available heater elements is equal to the total number of heater elements (e.g., four; elements 204, 205, 206, and 207) minus the number of faulty elements (e.g., one; element 204). If MCU 201 determines that there are no faulty elements, "OPERATION" state 304 is placed in a normal mode sub-state (not shown) and the operation process continues to Step 404 (Step 402; Yes). On the other hand, if MCU 201 detects a faulty element, MCU 201 may place "OPERATION" state 304 in a limp mode sub-state (not shown) (Step 402; No). During limp mode, MCU 201 disables any detected faulty heater elements (Step 403), and the operation process continues to Step 404.

In Step 404, MCU 201 determines the number of elements required to meet the power request received in Step 400. In one embodiment, MCU 201 may perform a calculation process to determine the number of elements required to meet the power request. Based on the power request, MCU 201 determines which heater elements should operate in a constant ON controlled mode and which (if any) heater elements should operate in PWM mode. For example, if heater elements 204, 205, 206, and 207 each provide 750 W of power and the power request is for 1875 W of power, MCU 201 may determine that the number of required elements to operate in a constant ON controlled mode is two, and the number of required elements to operate in a PWM mode is one. This is based on the amount of power provided by heater elements 204, 205, 206, and 207 in this example. For instance, because two elements that are operating in a constant ON mode will provide a total output of 750 W+750 W=1500 W of power, the PWM controlled output required is 1875 W−1500 W=375 W. Therefore, the required duty cycle of the PWM mode for the single PWM controlled heater element is 375 W/750 W=50%. As a result of this calculation, MCU 201 will designate one heater element to be PWM controlled with a 50% duty cycle, two elements to be constant ON controlled, and one element to be constant OFF controlled.

In another embodiment, MCU 201 may perform a predetermined algorithm when performing the calculation process in the event one or more heater elements 204, 205, 206, and 207 have different power output values. The predetermined algorithm may be based on a numerical order of the heater elements or a combination of the output value and physical positions of the heater elements.

In Step 405, MCU 201 sets the current limit for heater system 100 according to the number of elements that are calculated and to be turned on. Further, in Step 406, particular heater elements are selected for constant ON, constant OFF, and PWM controlled based on the calculation process performed in Step 404. MCU 201 then turns on or off heater elements 204, 205, 206, and 207 according to the selections in an increasing or decreasing sequence to soften the instant impact of output power. At this point, the optimized output power is applied to the heater elements so that a desirable temperature range is achieved. For example, if the first heater element 204 is PWM controlled, the next two heater elements 205 and 206 are constant ON controlled, and heater element 207 is constant OFF controlled, heater element 204 may be turned on first, then heater element 205, then heater element 206, and finally, if heater element 207 is already turned on, heater element 207 is then turned off.

In Step 407, the software programs executed by MCU 201 may wait for a new power request to be received from the host controller 208 or for an expiration of a pre-determined time period for rotating the duty of the elements. If a new power request is received from the host controller 208 (Step 408; Yes), the amount of the power requested is assessed in Step 409. In Step 409, if the amount of power request is not zero (Step 409; Yes), the process returns to Step 401 to readjust the output power controls. If, however, the amount of power request is zero (Step 409; No), the state then transitions from "OPERATION" state 304 to "STANDBY" state 303. If no new power request is received from the host controller 208 (Step 408; No), MCU 201 determines if a pre-determined time period has expired. If the time period has not expired (Step 410; No), the operation program returns to Step 407 to continue waiting for further events. If, however, the time period has expired (Step 410; Yes), the operation program continues to Step 411.

In Step 411, the duty of the heater elements is rotated so that the stress on each heater element is evenly distributed to extend the lifetime of heater elements 204, 205, 206, and 207. The rotation may be scheduled in different times or sequences. For example, the rotation may be done by rotating all the heater elements in sequence. Thus, if heater element 204 is currently PWM controlled, heater elements 205 and 206 are currently constant ON controlled, and heater elements 207 is currently constant OFF controlled, the rotation sequence may result in heater elements 204 and 205 being constant ON controlled, heater element 206 being constant OFF controlled, and heater element 207 being PWM controlled. Other rotation sequences may be implemented and the disclosed embodiments are not limited to the examples listed above.

Returning back to FIG. 3, while in "OPERATION" state 304, if MCU 201 receives on or more interrupts regarding any fault conditions, MCU 201 may transition "OPERATION" state to "FAULT" state 307.

Further, while in "STANDBY" state 303, if MCU 201 receives a flash program message from host controller 208, the state transitions to "FLASH" state 306. On entering "FLASH" state 306, MCU 201 downloads a new software program into the memory 202 from host controller 208. Subsequently, MCU 201 replaces a current version of the software program with the newly downloaded software program. After the replacement is completed or if MCU 201 receives a flash-program finished message (optionally followed by a standby message), the state transitions to "STANDBY" state 303. Further, while in "FLASH" state 306, if MCU 201 performs the program-flashing operation unsuccessfully, or detects any other fault conditions, the state transitions to "FAULT" state 307.

While in the "FAULT" state 307, MCU 201 handles faults in various manners including, for example, sending status messages back to host controller 208, presenting a fault related message on external display devices (not shown), and/or taking actions to eliminate the fault conditions, such as resetting or disabling the faulty devices. After all the faults are handled or processed, the state then transitions to either "STANDBY" state 303 if continuing operation is desired and possible, or to "SHUTDOWN" state 308 if the faults cannot be handled properly and shutdown of heater system 100 is desired.

Also, while in the "STANDBY" state 303, if MCU 201 does not receive an instruction from host controller 208 for a predetermined period of time and the bus voltage on the load circuitry is within a predefined range of a zero voltage value, the state transitions to "SLEEP" state 305. On entering "SLEEP" state 305, MCU 201 is set to sleep mode in order to conserve power. If MCU 201 receives a wakeup message from host controller 208, the state transitions to "STANDBY" state 303 again.

Additionally, while in the "STANDBY" state 303, if MCU 201 receives a shutdown command from host controller 208, or if MCU 201 determines a shutdown sequence is needed to respond to some external or internal event, the state transitions to "SHUTDOWN" state 308. On entering "SHUTDOWN" state 308, the power stage operation is stopped according to a turn off sequence to soften the instant impact of output power on the circuitry. That is, the power to heater elements 204, 205, 206, and 207 is turned off in an increasing or decreasing sequence. MCU 201 also minimizes execution of its software programs to prepare MCU 201 for a power shutdown. The state then transitions to "OFF" state 301.

It should be understood that the sequence of events and steps in FIGS. 3 and 4 are exemplary and not intended to be limiting. Thus, other method steps may be used, and even within the steps depicted in FIG. 4, the particular order of steps may vary. Moreover, certain steps may be removed, added, or modified to perform functions consistent with the disclosed embodiments.

INDUSTRIAL APPLICABILITY

Consistent with the disclosed embodiments, methods and systems may facilitate temperature control in confined-space environments. In one example, a work machine may have a cabin where an operator desires to fine-tune the temperature range of the cabin to obtain a comfortable work environment. Methods and systems consistent with disclosed embodiments may enable a heater system to provide the desired temperature range.

In one embodiment, the disclosed embodiments may collectively use PWM control and constant ON/OFF control processes to fine-tune the output power to the heater elements while reducing input current ripple. In this fashion, methods and systems consistent with disclosed embodiments may extend the lifetime of electrical and electronic components while reducing radio frequency interference (RFI).

Other embodiments, features, aspects, and principles of the disclosed exemplary systems may be implemented in various environments and are not limited to a work site environment. For example, a work machine with an interface control system may perform the functions described herein in other environments, such as mobile environments between job sites, geographic locations, and settings. Further, the processes disclosed herein are not inherently related to any particular system and may be implemented by a suitable combination of electrical-based components. Embodiments other than those expressly described herein will be apparent to those skilled in the art from consideration of the specification and practice of the disclosed systems.

What is claimed is:

1. A method for controlling output power to a plurality of heater elements in an electric heater system, comprising:

receiving a power request;

providing output power controls for each heater element;

determining at least one heater element to be pulse width modulation (PWM) controlled;

determining at least one other heater element to be constant ON/OFF controlled;

selectively controlling the output power to the determined heater elements to meet the power request; and changing output power control for at least one heater element from PWM controlled to constant ON/OFF controlled after a predetermined time period.

2. The method in claim 1, wherein controlling the output power further includes:

setting a current limit based on a number of the heater elements used to meet the power request; and selectively turning on or turning off the number of the heater elements in a predetermined sequence.

3. The method in claim 1, wherein selectively controlling the output power includes:

selectively providing power to the at least one PWM controlled heater element based on the power request.

4. The method in claim 3, further including:

selectively providing power to the at least one other constant ON/OFF controlled heater element based on the power request, wherein the power provided to the at least one PWM controlled heater element and the at least one other constant ON/OFF controlled heater element collectively meet the power request.

5. The method of claim 4, wherein selectively providing power to a PWM controlled heater element includes:

determining a duty cycle for a power signal associated with the at least one PWM controlled heater element based on the power request and the power provided to the at least one other constant ON/OFF controlled heater element.

6. An electric heater control system for controlling output power to a plurality of heater elements in an electric heater system, comprising:

means for receiving a power request;

means for determining at least one heater element to be pulse width modulation (PWM) controlled;

means for determining at least one other heater element to be constant ON/OFF controlled;

means for selectively controlling the output power to the determined heater elements to meet the power request; and means for changing output power control for at least one heater element from PWM controlled to constant ON/OFF controlled after a predetermined time period.

7. The system in claim 6, wherein the means for controlling the output power further includes:

means for setting a current limit based on a number of the heater elements used to meet the power request; and means for selectively turning on or turning off the number of the heater elements in a predetermined sequence.

8. The system in claim 6, wherein means for selectively controlling the output power includes:

means for selectively providing power to the at least one PWM controlled heater element based on the power request.

9. The system in claim 8, further including:

means for selectively providing power to the at least one other constant ON/OFF controlled heater element based on the power request, wherein the power provided to the at least one PWM controlled heater element and the at least one other constant ON/OFF controlled heater element collectively meet the power request.

10. The system in claim 9, wherein means for selectively providing power to a PWM controlled heater element includes:

means for determining a duty cycle for a power signal associated with the at least one PWM controlled heater element based on the power request and the power provided to the at least one other constant ON/OFF controlled heater element.

11. A system for controlling output power to a plurality of heater elements in an electric heater system, comprising:

a memory including program code that performs an operation process when executed, the operation process including:

receiving a power request including a requested power value;

determining a first set of the heater elements to operate in a constant ON mode based on the power value;

determining a second set of the heater elements to operate in a PWM controlled mode; and providing power to the first and second sets of heater elements based on the power value and a predetermined algorithm; and a microcontroller executing the program code to control power to the heater elements.

12. The system in claim 11, wherein each of the heater elements provide identical levels of power.

13. The system in claim 12, wherein determining a first set of the heater elements further includes:

determining a total number of the first set of heater elements as a quotient of the requested power value divided by a level of power provided by one of the heater elements.

14. The system in claim 13, wherein determining a second set of the heater elements further includes:

determining a total number of the second set of heater elements as one; and determining a duty cycle of the determined heater element based on a remainder of the division and a level of power provided by the determined heater element.

15. The system in claim 11, wherein one or more of the heater elements provide different levels of power than other heater elements.

* * * * *